United States Patent [19]

Becker

[11] Patent Number: 4,877,009

[45] Date of Patent: Oct. 31, 1989

[54] BOWSTRING DRAW AND RELEASE DEVICE

[76] Inventor: Richard R. Becker, 9910 Pecos St., Thornton, Colo. 80221

[21] Appl. No.: 192,693

[22] Filed: May 9, 1988

[51] Int. Cl.[4] ..... F41C 19/02

[52] U.S. Cl. ..... 124/35 A

[58] Field of Search ..... 124/35 A, 35 R, 31, 124/33, 40

[56] References Cited

U.S. PATENT DOCUMENTS

| | | | |
|---|---|---|---|
| 3,749,076 | 7/1973 | Suski et al. | 124/31 |
| 3,818,888 | 6/1974 | Keeney et al. | 124/35 A |
| 4,105,011 | 8/1978 | Chism | 124/35 A |
| 4,282,851 | 8/1981 | Lyons | 124/40 X |
| 4,308,851 | 1/1982 | Kaine, Jr. et al. | 124/35 A |
| 4,476,845 | 10/1984 | Rickard | 124/35 A |
| 4,665,886 | 5/1987 | Barlow | 124/35 A |

*Primary Examiner*—Randolph A. Reese
*Assistant Examiner*—Peter M. Cuomo
*Attorney, Agent, or Firm*—Charles C. Corbin

[57] ABSTRACT

Disclosed is a device for drawing an archery bowstring and for automatically releasing it when the draw weight of the bowstring exceeds a predetermined valve. This is a main body having a front end that anchors the terminal ends of a forwardly extending flexible cord loop, and having a rear end adapted to have attached an archer's hand loop. A lever mechanism is pivotally mounted to the body and has an initial position in which a lever edge portion is angled so as to releasably retain the bight of the loop after the loop has been engaged around the bowstring. A spring-biased member, with a screw to adjust spring force, is also mounted in the body, and provides a depressible projection which will engage one side of a cam-like protuberance carried by the lever mechanism to hold it in its initial position. When the bowstring is drawn with force exceeding a predetermined value, sufficient torque is generated in the lever mechanism to depress the spring-biased member whereby it immediately rotates to release the cord loop and bowstring.

11 Claims, 3 Drawing Sheets

BOWSTRING DRAW AND RELEASE DEVICE

BACKGROUND

The present invention relates generally to archery devices, and more particularly to a device for drawing a bowstring and automatically releasing it when its draw weight exceeds a predetermined amount.

In order to shoot an arrow at a target, the archery marksman must fully draw the bow, "settle in" on the target, aim, and release the arrow. The properly aimed arrow will then be most accurately propelled towards its intended target if the bowstring is released smoothly with a minimum of deviation-causing finger or hand movement coincidental with the release. Thus the prior art regarding devices for increasing archery accuracy is replete with aids for drawing and releasing a bowstring. The advent of mechanical devices utilizing a twine loop which is temporarily looped around the bowstring and then engaged over a releasable holding member has improved the art, particularly when coupled with a triggering mechanism that the archer can set off by his triggering finger in much the same fashion that a gun is fired. Various, of the fair number of such aids, are disclosed in U.S. Pat. Nos. 4,003,348, 4,022,181, 4,489,705 and 4,308,851.

While these and other prior art devices represent improvements in certain aspects of release aids, there remain drawbacks that are apparently inherent in trigger release devices. To wit there has developed the problem of flinching, jerking and/or punching of the trigger by the archer anticipating the release going off, which causes the released arrow to waiver from its intended target. Another concern of the archery marksman, and one which greatly affects shooting consistency, is the problem of not being sure that the bow is at full draw prior to release. This problem tends to emerge when the archer becomes fatigued and tires after continual shooting. Thus with less than full draw, an otherwise accurately aimed arrow will be propelled on a trajectory that falls short of the intended target.

SUMMARY OF THE INVENTION

In view of the foregoing it is a general object of the present invention to avoid the aforementioned drawbacks of conventional archery draw and release aids.

Another object is to provide a draw and release device that will enhance consistency of an archer's marksmanship.

Another object is to provide an archery release device which ensures that an arrow will not be released until full draw is reached.

A further object is to provide a release aid which can be adjusted so that release consistently occurs at a predetermined pull weight.

A still further object is to provide an archery release device which greatly minimizes the tendency of "flinching,: "punching,and "jerking" at the point of release.

These and even further objects and advantages are attainable by the present invention which is designed to automatically release a bowstring when its draw weight exceeds a pre-set amount. There is a main housing having a front end to which is affixed the terminal ends of a forwardly projecting loop of twine, and having a rear end adapted to hold an archer's hand loop. Lever means, including a holding member, for releasably retaining the bight of the twine loop after the loop has been disposed around the bowstring and brought into tensioned relationship therewith, is pivotally mounted to the housing, and has an initial position in which it is angled so as to hold the twine loop, and a release position to which it may rotate to release or slip off the loop. The lever means also includes a cam-like protuberance pivotable therewith. The invention also features spring-biased means mounted to the housing, and which provides a depressible cam-following member which engages a portion of said protuberance with an adjustable amount of force so as to hold the lever means against rotation from its initial position, and whereby the lever means is rotatable to its release position when a predetermined amount of bow string-generated force in said twine loop creates torque in the lever means sufficient to cause the cam-following member to be depressed. A modification of the invention includes a T-grip attached to the housing and comprising a first and second handle bars which extend at about 90 degrees from opposite ends of the housing, with a spring-biased, thumb operated plunger mounted in one of the bars for releasably engaging the lever mechanism, as desired, to hold it in its initial position.

Additional advantages and novel features of the present invention will be apparent upon a reading of the detailed description and claims which follow.

DETAILED DESCRIPTION

Figure 2:
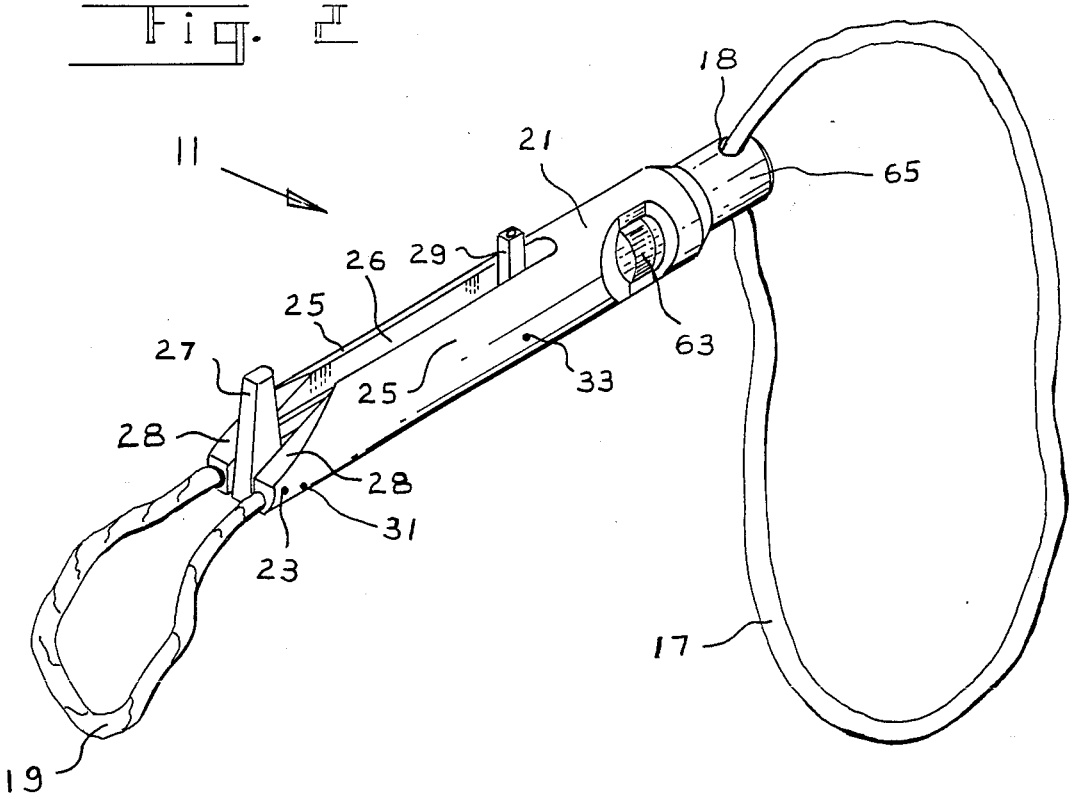
FIG. 2 is a front perspective view showing the draw and release device of the invention.
Figure 1:
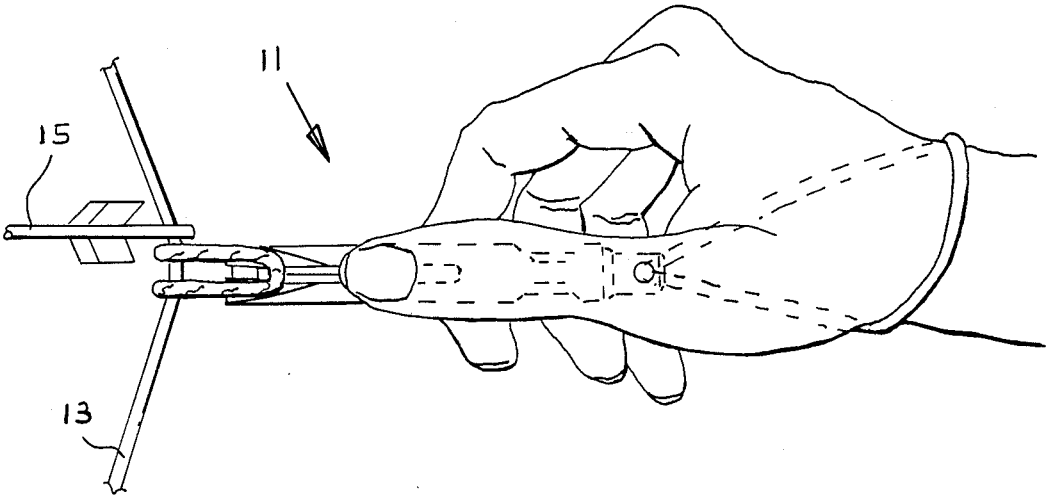
FIG. 1 is a side elevational view showing in use an archery draw and release device according to the invention.
Figure 3:
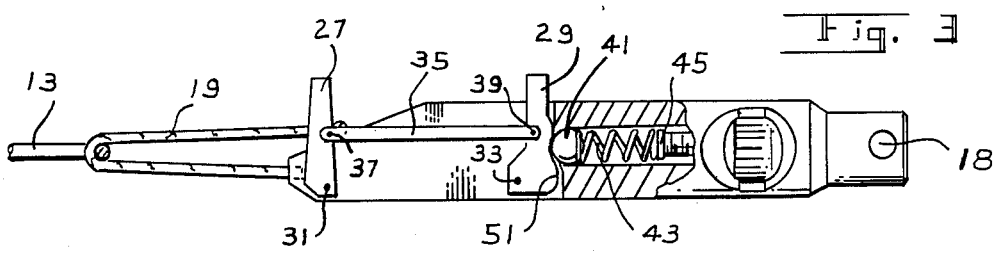
FIG. 3 is a partially sectional, bottom view with parts broken away to illustrate the initial loop holding configuration of an embodiment of the invention.
Figure 5:
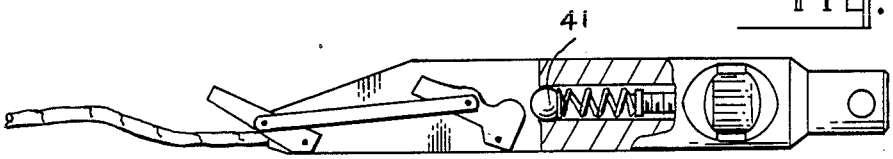
FIG. 5 is similar to FIG. 4 but shows the complete pivoting of the lever mechanism.

Referring now to the drawings, FIG. 1 depicts the inventive archery draw and release device 11, to be described, being employed to draw back a bowstring 13 preparatory to shooting of arrow 15. As best shown in FIGS. 2 and 3, terminal ends of flexible twine loop 19, preferably comprising a woven nylon or like material, are received in bores in the front end of housing 21 and secured in a conventional manner by locking screws 23 which may comprise Allen screws. Housing 21 has laterally spaced apart wall portions 25 which define a longitudinally extending slot 26 which mounts the pivoting elements of the device, namely the loop holding arm 27 and the cammed lever 29. Sloping facets 28 are provided in the forward portions of portions 25. FIG. 3 shows that arm 27 which is rotatably mounted over a pivot pin 31 and the lever 29 which is rotatably mounted over a pivot pin 33, are connected by a linking arm 35 to which they are joined by pivot pins 37 and 39 respectively. Thus rotation of one of these pivoting elements will cause rotation of the other. FIG. 3 also shows a ball bearing 41 that slidingly resides in the forward end of a longitudinally extending bore in housing 21. Ball bearing 41 is urged in a forward direction by a compression spring 43 which is held in a compressed state under force of a pressure plate 45 at the front end of an adjustable screwjack mechanism which will be described in further detail hereinafter. The somewhat constricted walls at the forward end of the interior bore limit the forward movement of ball 41, but allow a substantial portion of the latter to project into the slot 26. This projecting ball portion is received within a concave seat which lies between the upper and lower protuberances 50 and 51 respectively, of the cammed lever 29. In this manner cammed lever 29 is held in the upright, initial position displayed in FIG. 3, and, by virtue of its linked relationship to lever 29, the holding arm 27 is also held in a generally upright initial position. It will be seen that under certain situations that this linkage will permit cammed lever 29 to function as a "safety" when it is held against rotation mechanically or by a finger. During the release sequence of operation which will be later described, the pivotally mounted elements are jointly rotatable to the position shown in FIG. 5.

Figure 6:
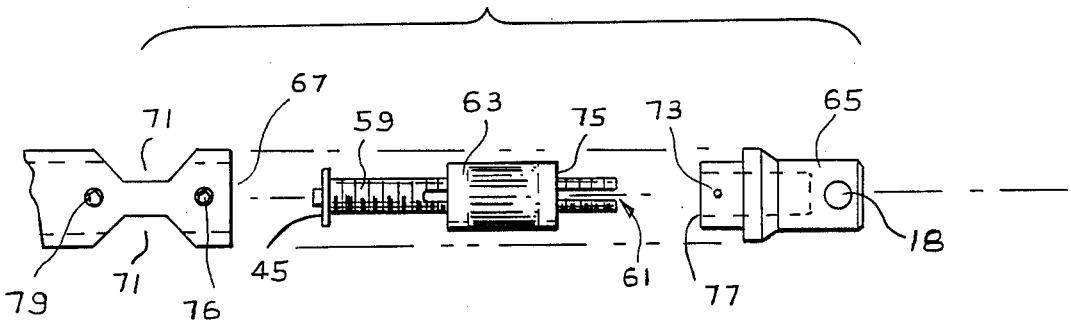
FIG. 6 is an enlarged, partial, exploded view showing the adjusting mechanism according to the invention.

The exploded view of FIG. 6 shows the main components of the screw-jack assembly to comprise adjust screw 59 with elongated slot 61 and pressure plate 45; an internally threaded and externally knurled adjusting knob 63 which engages screw 59; and an end cap 65 which has a bore which accepts a portion of the screw 59. When assembled and mounted through housing opening 67, the housing side windows 71 will provide access to the knurled surface of adjusting knob 63, and a cross pin 73 will lie loosely in slot 61. A set screw 76 on each side of the housing will secure the assembled end cap 65. When the knob 63 is rotated so as to advance the pressure plate 45, the cross pin 73 will serve to hold the adjusting screw from rotating with the knob 63. During the pressure exerting process the rear surface 75 of knob 63 will bear against the end cap surface 77. A set screw 79, preferably an Allen screw, can be tightened to engage the surface of knob 63 when it is desired to hold a given amount of forward pressure on the ball bearing 41.

Figure 4:
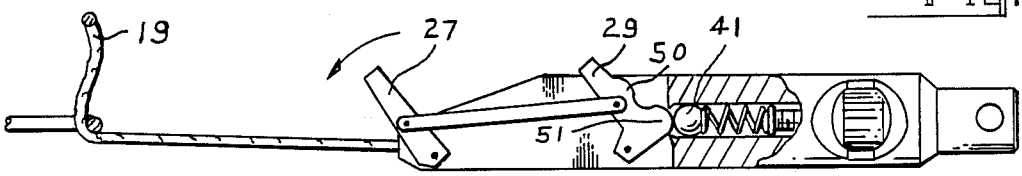
FIG. 4 is similar to FIG. 3 but illustrates the pivoting of the lever mechanism so as to tend to release the loop.

During operation of device 11, the twine loop 19 is hooked around the bowstring 13, just under the arrow 15 as shown in FIG. 1, and then placed over the holding arm 27 and seated upon facets 28. As the archer draws bowstring 13 the tension produced in loop 19 will exert a turning force on arm 27, which moment is transferred to the cammed lever 29 via linking arm 35. The lower protuberance 51 of lever 29 will thus be urged against ball bearing 41 with increasing pressure as the arm 29 is increasingly torqued. At a certain release weight the ball 41 will be suddenly depressed, and the arms 27 and 29 will rotate as illustrated in FIG. 4, causing the loop 19 to slip from holding member 27, thus releasing the bowstring and arrow.

The described device can be used advantageously with both a re-curve bow or a compound bow, the latter requiring a slightly different operational sequence. In either case calibration, i.e. the proper setting of adjusting knob 63, is first required. This is done using a conventional bow scale (not shown) to determine how much weight must be held at full draw. Next, the loop 19 of device 11 is placed around the hook portion of the scale and then placed over holding arm 27. The archer then pulls against the scale with device 11, noting the pull weight which causes "tripping" of arm 27. The knob 63 is adjusted so that release or "tripping" will occur at a draw weight slightly above that of the previously determined full draw weight.

The archer is then prepared to draw the bow, "settle in" and aim; and then release the bowstring in a smooth manner uniquely provided by device 11. It is to be noted that when a compound bow is being pulled to full draw it is necessary to grasp that top of cammed lever 29 and use it as a "safety," to prevent premature release. This is required because with a compound bow, characteristically there is a significant let off in holding weight when full draw is reached, and the release weight is exceeded at some point during the initial drawing procedure. With the compound bow and the re-curve bow, drawing the bowstring back beyond full draw will increase the holding weight to the point of automatic release. It is evident that release will not occur until a certain, set, draw length is achieved, thus the archer can gain a certain consistency of performance since his arrows will be propelled with identical force.

Figure 7:
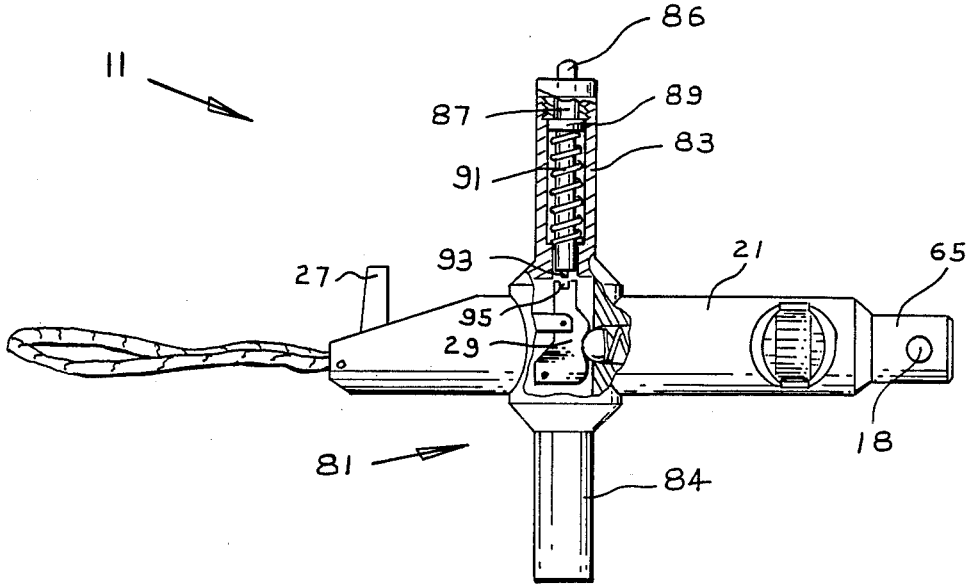
FIG. 7 is a bottom view showing the T-handle equipped modification of the invention.

FIG. 7 shows a modification of the invention which employs a T-handle 81 which is affixed to the body 21 and which has first and second handle bars 83 and 84. As an alternative to using a wrist strap or similar device which attaches to end cap 65 for holding release 11 during shooting, this embodiment provides the archer with handle bars 83 and 84 around which the archer's fingers are wrapped, with the body of release 11 resting against the palm of the hand. This modification also features a depressible plunger 87 mounted within handle bar 82 as shown, with a flange portion 89 engaged by coil spring 91 to urge plunger 87 in the upward position shown. The plunger upper end 86 protrudes through an opening in the top of handle 82. From the lower end of plunger 87 depends on engaging tip 93. A cavity 95 in the top of the cammed lever 29 is sized to receive tip 92. Thus the plunger may be used, as desired, as a "safety" by depressing the upper end 86 so as to cause tip 93 to engage cavity 95 which will hold lever 29 against rotation. By releasing the end 86, the plunger will disengage and return to the position shown in FIG. 7.

While it is preferably to employ the twine loop 19 when using release device 11, it should be noted that the inventive aspects of the invention may be embodied in a device in which a twine loop is not used, and in which the lever 27, lever 29 or their equivalent is engaged directly by a bowstring.

Preferred embodiments have been described and it should be appreciated by those with ordinary skill in the art, that within the scope of the invention, various changes may be made. For example, design considerations in some cases, within the invention may call for various configurations for the "cammed" region of lever 29 and for various structures that are equivalent to ball bearing 41. Thus it is aimed to cover all changes as fall within the true spirit and scope of the invention.

What is claimed is:

1. Device for drawing and automatically releasing an archery bowstring, comprising:

a. main body, adapted to be held by an archer;

b. means for releasably retaining said bowstring including lever means pivotally mounted to said body and having an initial orientation in which it retains said bowstring and being pivotable to a bowstring releasing position, said lever means providing a radially extending protuberance;

c. adjustable, spring biased means mounted to said main body, and providing a depressible member which engages said protuberance to hold with an adjustable amount of force said lever means against rotation from its bowstring retaining position, and wherein said lever means is rotated to its release position when a predetermined amount of bowstring generated force creates torque in said lever means sufficient to cause said protuberance to depress said member.

2. Device as defined in claim 1 wherein said lever means provides an edge adapted to engage and hold a forwardly urged string against movement when in its initial orientation, and to allow said string to slip from said edge when said lever means is rotated to its release position.

3. Device as defined in claim 2 wherein said lever means includes a first lever pivotally mounted approximate the front end of said main body an dproviding said string engaging edge, a second lever spaced from said first lever and pivotally mounted to said body and providing said protuberance, and a connecting arm with opposite ends that pivotally link to intermediate portions of said first and second lever respectively, whereby rotation of said first lever causes rotation of said second lever.

4. Device as defined in claim 3 wherein the upper portion of said second lever is adapted to be held against rotation.

5. Device as defined in claim 1 wherein said protuberance has a cam-like engaging surface.

6. Device as defined in 5 wherein said depressible member has a spherical engaging surface.

7. Device as defined in claim 1 wherein said means for releasably retaining said bowstring includes a forwardly disposed flexible core loop having terminal ends secured to the front end of said main body, and the bight of said loop is engagable by said lever means.

8. Device as defined in claim 1 wherein said spring biased means includes a coil spring and means to adjustably compress said spring.

9. Device as defined in claim 1 wherein said depressible member is urged forwardly.

10. Device as defined in claim 1 including a T-handle attached to said body and having first and second handle portions each extending from opposite sides of said body at a generally normal direction to said body.

11. Device as defined in claim 10 including plunger mechanism mounted in one of said handle portions, said plunger mechanism having a spring-biased plunger which is depressible to make releasable engagement with said lever means to prevent rotation thereof.

* * * * *